US008387821B2

(12) United States Patent
Yin

(10) Patent No.: US 8,387,821 B2
(45) Date of Patent: Mar. 5, 2013

(54) FOOD CONTAINER

(75) Inventor: Der-I Yin, New Taipei (TW)

(73) Assignee: Der I Industrial Co., Ltd., New Taipei (TW)

( * ) Notice: Subject to any disclaimer, the term of this patent is extended or adjusted under 35 U.S.C. 154(b) by 0 days.

(21) Appl. No.: 13/078,475

(22) Filed: Apr. 1, 2011

(65) Prior Publication Data

US 2012/0248120 A1 Oct. 4, 2012

(51) Int. Cl.
*B65D 41/16* (2006.01)
*B65D 41/18* (2006.01)

(52) U.S. Cl. ..... 220/780; 220/796; 220/793; 220/315; 220/675; 229/406

(58) Field of Classification Search ..... 220/675, 220/780–796, 4.21, 315; 229/406
See application file for complete search history.

(56) References Cited

U.S. PATENT DOCUMENTS 5,553,701 A * 9/1996 Jarecki et al. ..... 206/15.2
6,056,138 A * 5/2000 Chen ..... 220/4.21
6,196,404 B1 * 3/2001 Chen ..... 220/4.21
6,460,716 B1 * 10/2002 Wong ..... 220/4.24
6,786,329 B2 * 9/2004 Onishi ..... 206/209
6,883,678 B2 * 4/2005 Chou ..... 220/793
6,923,338 B2 * 8/2005 Dees et al. ..... 220/793
7,055,712 B2 * 6/2006 Tang ..... 220/4.21
7,097,066 B2 * 8/2006 Tucker et al. ..... 220/780
7,891,514 B1 * 2/2011 Walsh et al. ..... 220/4.21

* cited by examiner

*Primary Examiner* — J. Gregory Pickett
*Assistant Examiner* — Blaine Neway
(74) *Attorney, Agent, or Firm* — Muncy, Geissler, Olds & Lowe, PLLC

(57) ABSTRACT

A food container includes a body and a lid. The body has a first containing space which has a first opening and a first rim on the edge of the first opening. The lid has a second rim coupled to the first rim. The first rim is extended to form a first horizontal section which is extended to form a first bent section. The first bent section further is extended to form a first latch section. The second rim is extended to form a second horizontal section, a second bent section and a second latch section. The first and second latch sections have respectively a first and second positioning portion. When the lid covers the body, the second horizontal section presses the second bent section in contact with the first bent section so that the first and second positioning portions are engaged, thereby to enhance coupling strength and sealing tightness.

4 Claims, 3 Drawing Sheets

FOOD CONTAINER

FIELD OF THE INVENTION

The present invention relates to a food container and particularly to a food container including a lid and a body latched with each other.

BACKGROUND OF THE INVENTION

Food container (or lunch box) is one of essential goods during having meals. A conventional lunch box generally includes a container to hold the foods that is sealed by a lid to keep the foods clean. Most of the conventional lunch boxes are made of metal (such as stainless steel). However, nowadays most people are busy in work, especially students or office workers, few have time to prepare lunch or care much about preparing lunch. Hence eating out becomes a rising choice for many people. Most of the food containers used for eating out are microwave-enabled, such as those sold in convenience stores and mainly made of PP (polypropylene), with a transparent lid to enable consumers to see the food inside to decide whether to buy or not.

U.S. Pat. No. 6,883,678 entitled "Food container sealing structure" includes a body and a cover. The body and cover have respectively a flange on the rim that has a transverse edge and a longitudinal edge. The transverse edge of the cover has a first annular rib coupled to a first annular groove formed on the transverse edge of the body. The longitudinal edge of the cover has a second annular rib latched with a second annular groove formed on the longitudinal edge of the body. Through the first and second annular grooves and first and second annular ribs, the cover and body can be latched tightly to seal foods in the container.

However, the aforesaid conventional technique still has drawbacks, notably the first annular groove and first annular rib formed respectively on the transverse edges of the body and cover diminish the transverse support strength. Hence the cover is easily deformed and displaced when being subject to forces from users, and results in unsecured latching between the second annular rib and second annular groove on the longitudinal edges of the body and cover. Moreover, due to dimensional errors always taking place during injection molding of plastic products, the dimensional errors among the first annular rib and groove and the second annular rib and groove make the cover could not be fully covered on the body, and result in easy separation or non-tightness. Liquid foodstuff held in the body could be leaked out as well.

SUMMARY OF THE INVENTION

The primary object of the present invention is to solve the disadvantages of the aforesaid conventional technique of inadequate coupling strength and easy loosening.

To achieve the foregoing object, the present invention provides a food container which includes a body and a lid coupled to the body. The body has a first containing space to hold the foods. The first containing space has a first opening at one end and a first rim on the edge of the first opening. The lid has a second containing space. The second containing space has a second opening at one end and a second rim on the edge of the second opening to couple to the first rim. The first rim is extended to form a first horizontal section. The first horizontal section also is extended to form a first bent section and forms a first flat surface between the first rim and first bent section. The first bent section further is extended to form a first latch section. The second rim is extended to form a second horizontal section. The second horizontal section is extended to form a second bent section and forms a second flat surface between the second rim and second bent section. The second bent section further is extended to form a second latch section. The first and second latch sections have respectively a first positioning portion and a second positioning portion corresponding to each other. When the lid covers the body, the second horizontal section presses the second bent section to butt the first bent section, and the first positioning portion and second positioning portion are engaged with each other and positioned to form a closed state.

In an embodiment of the invention, the first latch section of the body is extended horizontally outwards to form a first extension section, and the second latch section has a second extension section corresponding to the first extension section. In the closed state, the second extension section is closely in contact with the first extension section to form a tight sealing between the lid and body. The first latch section of the body also is extended outwards to form a first pulling portion, and the second latch section of the lid has a second pulling portion corresponding to the first pulling portion. The first and second pulling portions are formed in arched flanges to facilitate opening by users to separate the lid and body.

Through the first and second flat surfaces respectively on the first and second horizontal sections, the transverse bracing strength of the first and second horizontal sections are enhanced so that when the lid covers the body, the external bracing force is transferred through the second rim, second horizontal section and second bent section to the second positioning portion of the second latch section, as a result, the first and second positioning portions can be positioned together to enhance the coupling strength and sealing tightness between the lid and body.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
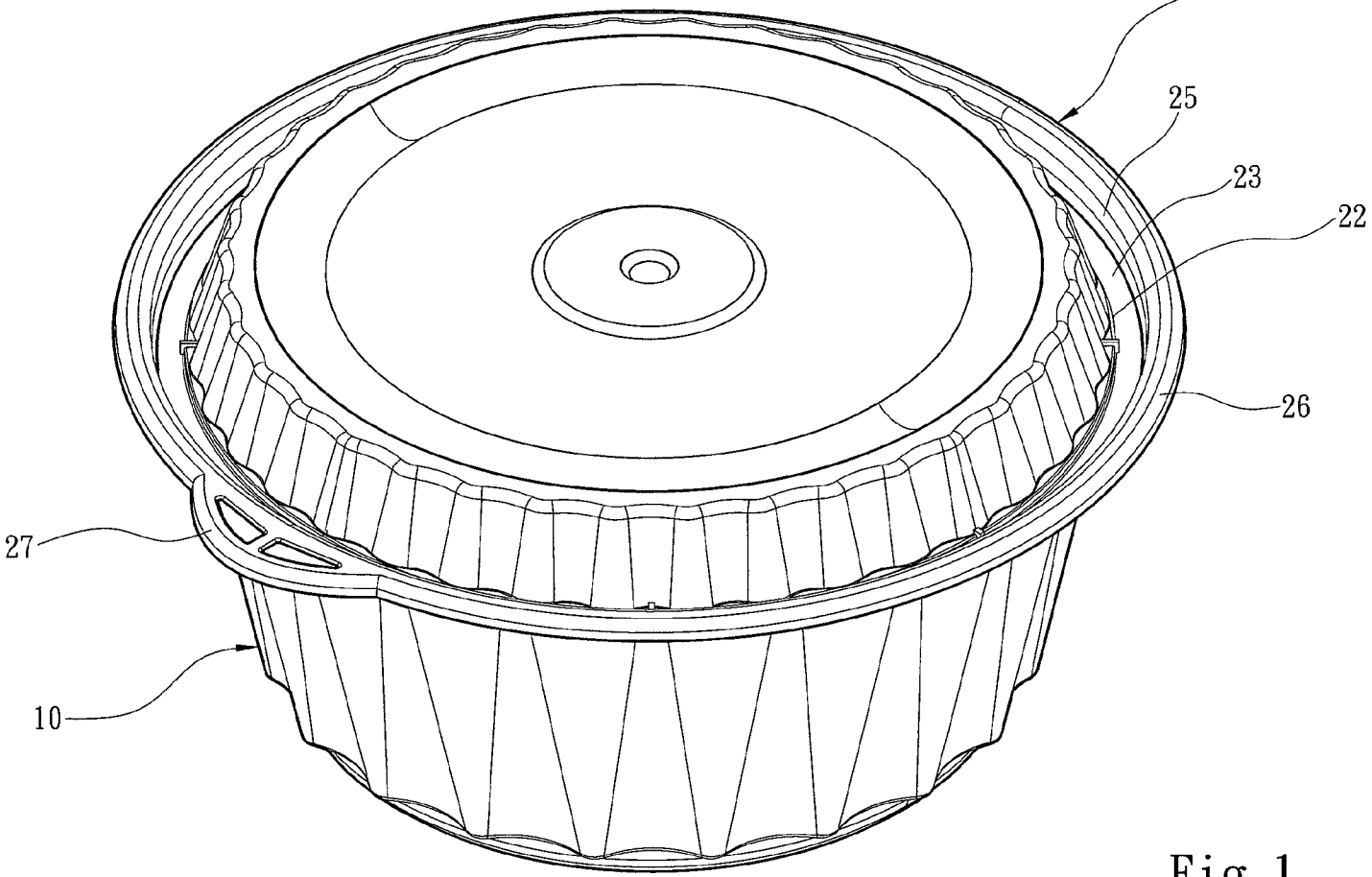
FIG. 1 is a perspective view of the food container of the invention.
Figure 2:
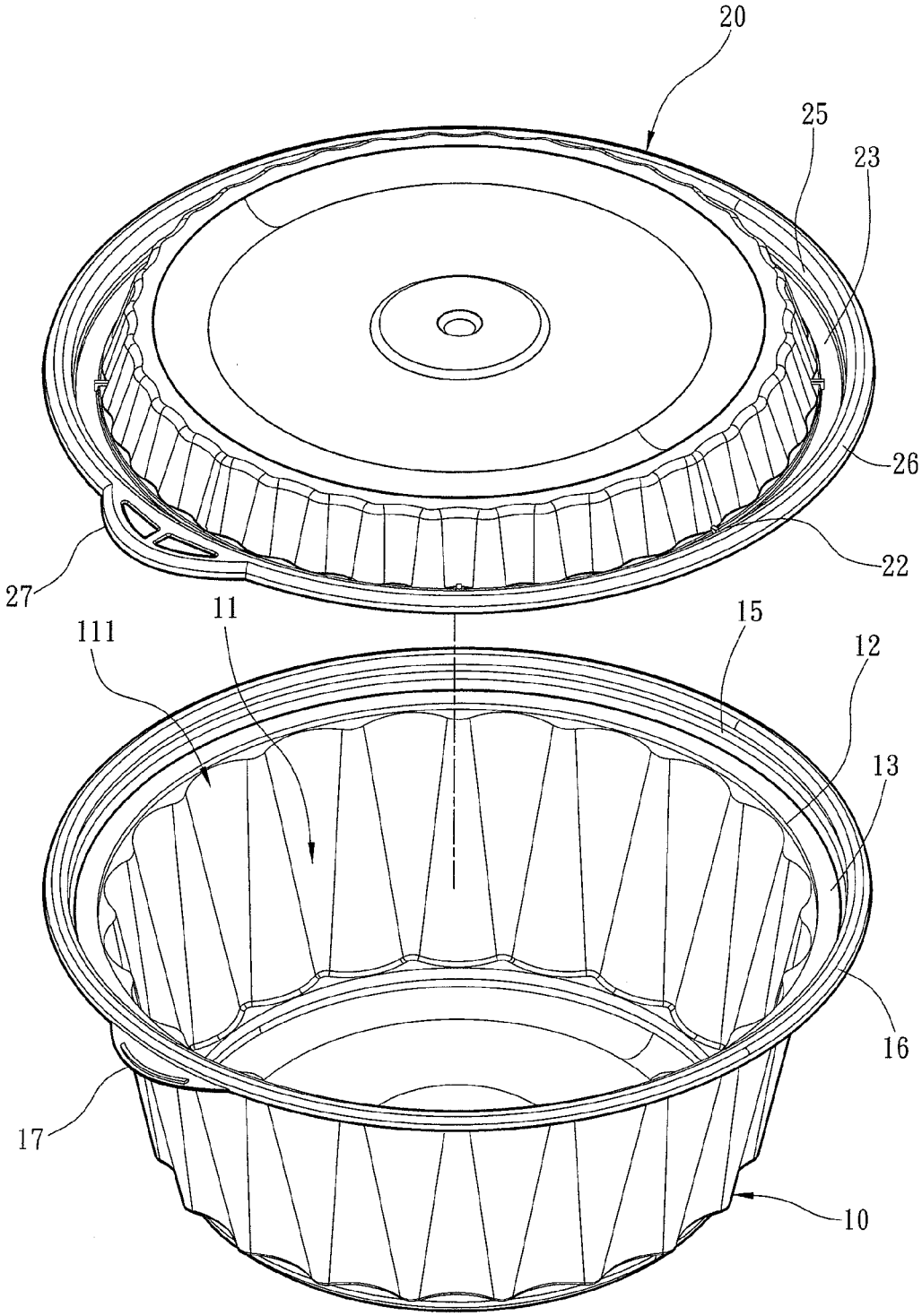
FIG. 2 is an exploded view of the food container of the invention.

Please refer to FIGS. 1 and 2, the food container according to the invention includes a body 10 and a lid 20 coupled to the body 10. The body 10 has a first containing space 11 to hold the foods. The first containing space 11 has a first opening 111 at one end and a first rim 12 on the edge of the first opening 111. The lid 20 has a second rim 22 corresponding to the first rim 12 to couple to the first rim 12 of the body 10 to seal the food container.

Figure 3:
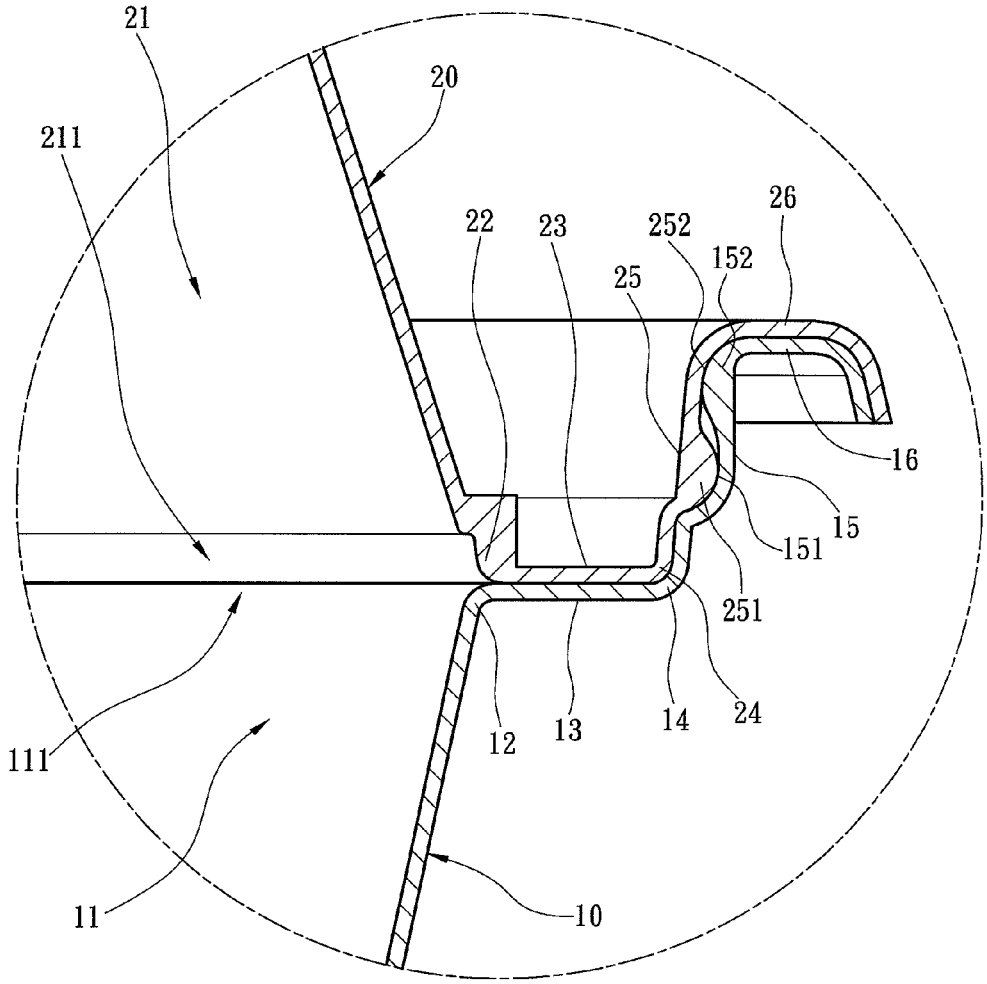
FIG. 3 is a fragmentary enlarged view of the food container of the invention.

Also referring to FIG. 3, the lid 20 has a second containing space 21 corresponding to the first containing space 11 of the body 10. The second containing space 21 has a second opening 211 at one end. The second rim 22 is located on the edge of the second opening 211. The first and second containing spaces 11 and 21 can hold the foods. The first rim 12 of the body 10 is extended to form a first horizontal section 13 which is further extended to form a first bent section 14. The first horizontal section 13 forms a first flat surface between the first rim 12 and the first bent section 14. The first bent section 14 is extended to form a first latch section 15 which is further extended outwards to form a first extension section 16. The second rim 22 corresponding to the first rim 12 is extended to form a second horizontal section 23. The second horizontal section 23 also is extended to form a second bent section 24. The second horizontal section 23 forms a second flat surface between the second rim 22 and second bent section 24. The second bent section 24 is extended to form a second latch section 25 which is further extended outwards to form a second extension section 26 corresponding to the first extension section 16. In this embodiment, the first extension section 16 and second extension section 26 are curved covers matching each other. The first latch section 15 of the body 10 also is extended outwards to form a first pulling portion 17. The second latch section 25 of the lid 20 is extended outwards to form a second pulling portion 27 corresponding to the first pulling portion 17. In this embodiment, the first and second pulling portions 17 and 27 are arched flanges corresponding to each other to be pushed by users with opposite forces to separate the lid 20 and body 10. Thus forms the main structure of the invention.

The body 10 and lid 20 form a closed state. The first latch section 15 and second latch section 25 have respectively a first groove 151 and a first boss 152; and a second boss 251 and second groove 252 corresponding to each other. In this embodiment, the first groove 151 couples with the second boss 251. The first boss 152 couples with the second groove 252. In the closed state, the first rim 12 and second rim 22 are coupled together with the second horizontal section 23 of the lid 20 pressing the second bent section 24 so that the second bent section 24 butts the first bent section 14 of the body 10, and the first groove 151 and second boss 251 are engaged with each other and positioned and the first boss 152 and the second groove 252 are engaged with each other and positioned. The first extension section 16 is in contact with the second extension section 26 to allow the lid 20 and body 10 to form tight coupling. When in use, the user exerts opposite forces to the lid 20 and body 10 to disengage the second boss 251 from the first groove 151 and the second groove 252 from the first boss 152, so that the lid 20 can be separated from the body 10. When the lid 20 is subject to the pulling force, the second flat surface of the second horizontal section 23 neither being deformed nor displaced easily, so that the lid 20 is hard to be separated from the body 10.

As a conclusion, the first and second groove 151 and first boss 152 and second groove 252 and second boss 251 are formed respectively on the first and second latch sections 15 and 25, and the first and second horizontal sections 13 and 23 are formed in flat surfaces. When the lid 20 is tightly latched on the body 10, the lid 20 provides an external bracing force transferred from the second rim 22 directly through the second horizontal section 23, second bent section 24 to the second boss 251 and second groove 252 of the second latch section 25, so that the first and second grooves and bosses have sufficient positioning strength to enhance the coupling strength and sealing tightness between the lid 20 and body 10.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A food container, comprising:

a body including a first containing space which forms a first opening at one end and a first rim on the edge of the first opening, the first rim being extended to form a first horizontal section which is extended to form a first bent section, the first horizontal section forming a first flat surface between the first rim and the first bent section, the first bent section being extended to form a first latch section, the first latch section being extended horizontally outwards to form a first extension section; and a lid including a second rim to cover the first rim of the body, the second rim being extended to form a second horizontal section which is extended to form a second bent section, the second horizontal section forming a second flat surface between the second rim and the second bent section, the second bent section being extended to form a second latch section, the second latch section being extended horizontally outwards to form a second extension section;

wherein the body and the lid form a closed state in which the second horizontal section presses the second bent section to butt the first bent section so that the first and second latch sections are engaged with each other to allow the second extension section to contact the first extension section;

wherein the first extension section is extended to form a first pulling portion and the second extension section is extended to form a second pulling portion corresponding to the first pulling portion, the first and second pulling portions respectively receiving forces from a user on the body and the lid to release the closed state; and wherein the first latch section includes a first groove connected to the first bent section, and a first boss connected to the first groove and the first extension section, and wherein the second latch section includes a second boss connected to the second bent section and corresponding to the first groove, and a second groove connected to the second boss and the second extension section and corresponding to the first boss, and wherein when the body and the lid are in the closed state, the first boss and the second groove are engaged with each other above the engaged second boss and first groove, and the contour of the lower edge of the first groove matches the contour of the lower edge of the second boss while the contour of the upper edge of the first boss matches the contour of the upper edge of the second groove, so that the lid is firmly held by the body without loosening.

2. The food container of claim 1, wherein the first and second pulling portions are arched flanges extended respectively from the first and second latch sections.

3. The food container of claim 1, wherein the first extension section and the second extension section are curved covers extended respectively from the first and second latch sections.

4. The food container of claim 1, wherein the lid includes a second containing space which forms a second opening at one end, the second rim being located on the edge of the second opening, the first containing space and the second containing space communicating with each other and the first rim and the second rim being coupled with each other in the closed state.

* * * * *